United States Patent [19]

Castejon Castan

[11] 4,230,019

[45] Oct. 28, 1980

[54] FLUID ARRANGEMENT

[76] Inventor: Luis M. Castejoń Castan, Calle Pablo Casals, 12, Madrid, Spain

[21] Appl. No.: 959,781

[22] Filed: Nov. 13, 1978

[30] Foreign Application Priority Data

Nov. 12, 1977 [ES] Spain ..... 464093

[51] Int. Cl.[3] ..... F01B 7/18; F01B 11/02; F01B 25/04; F01L 25/04

[52] U.S. Cl. ..... 91/220; 91/319; 91/321; 92/85 B

[58] Field of Search ..... 91/319, 321, 220, 235; 92/85 B

[56] References Cited

U.S. PATENT DOCUMENTS

| | | | |
|---|---|---|---|
| 1,430,764 | 10/1922 | Smith | 91/300 |
| 3,207,043 | 9/1965 | Kay | 91/220 |
| 3,713,367 | 1/1973 | Butterworth | 91/321 |
| 3,774,502 | 11/1973 | Arndt | 91/321 |
| 4,020,747 | 5/1977 | Reynolds | 91/319 |

*Primary Examiner*—Paul E. Maslousky
*Attorney, Agent, or Firm*—Wenderoth, Lind & Ponack

[57] ABSTRACT

A fluid arrangement for the alternating operation of an apparatus includes a working cylinder with a working piston endowed with an alternating movement and a control cylinder with an alternatingly moving control piston. Each of the cylinders has for the respective piston a driving chamber which is alternately connected to a supply source of fluid under pressure and to a discharge opening for the fluid through a distributor, and a return chamber permanently connected to the supply source of fluid under pressure. The distributor connected to the driving chamber in the working cylinder is the control cylinder, and the distributor connected to the driving chamber in the control cylinder is the working chamber.

5 Claims, 2 Drawing Figures

FLUID ARRANGEMENT

BACKGROUND OF THE INVENTION

The present invention relates to fluid arrangements which determines the alternating movement of a driving member which hammers against an actuating element.

The cited arrangements are especially meant to be used in quarries or similar places during civil engineering operations where it is required to break up stone blocks of considerable size before setting them into breaking machines of the rockbreaker jaw type or similar types in order to crush the broken parts before introducing them into respective grinding mills.

SUMMARY OF THE INVENTION

The object of the present invention is to improve this type of arrangement and to develop an apparatus for performing such improvement.

The improvements in the fluid arrangements of the present invention comprise a fluid circuit for producing an alternating movement on determined elements in the circuit. A feeding line of fluid under pressure is connected to a fluid accumulator which is filled with a certain fluid load, to a return chamber of a working cylinder wherein a working piston is driven in an upward direction and into a chamber of a control cylinder, wherein a control piston is driven up to a first end position, thereby setting in communication two chambers of the control cylinder, one of which is connected with a driving chamber of the working cylinder and the other of which is chamber with a fluid discharge line to a tank. Thus, when the driving chamber is not under pressure the working piston travels upwardly while fluid from the driving chamber flows back to the tank through the fluid discharge line, the working piston connects the control chamber of the working cylinder with the return chamber thereof and shuts off the return chamber from the discharge chamber of the working cylinder. The fluid pressure acts in another chamber of the control cylinder, which offers a greater driving cross-section than the afore cited chamber of the control cylinder, thereby driving the control piston to a second end position where it shuts off the chamber of the control cylinder which communicates with the driving chamber from the chamber which is in connection with fluid discharge line to the tank, while connecting at the same time the chamber of the control cylinder which is in communication with the driving chamber with the chamber which is in communication with the inlet port of the fluid under pressure, at which moment the fluid pressure acts in the driving chamber of the working cylinder, thereby slowing down and stopping the working piston from travelling upwards, and thereafter driving it downwards. During this movement the working piston shuts off the return chamber from the control chamber of the working cylinder, thereby shutting off the fluid pressure to the corresponding control chamber and setting into communication the control chamber with the discharge chamber of the working cylinder, so that the control chamber is connected with the fluid discharge line. Thus, the thrust received by the control piston in the chamber which is connected to the inlet port of the fluid under pressure causes the displacement of the control piston towards the first end position. This connects the chamber of the control cylinder which is connected with the driving chamber in the working cylinder with the chamber which establishes a connection with the fluid discharge line and shuts off the chamber of the control cylinder which is connected with the driving chamber from the chamber which is in communication with the inlet port of the fluid under pressure. Thus, in such position only the fluid pressure in the return chamber is acting on the working piston, and the working piston starts anew its upward movement, thereby repeating the cycle, so that at the lower most point in its travel the working piston strikes against an actuating tool and imparts thereto its kinetic energy.

Furthermore, the present improvements foresee that the working piston forms, in combination with the chambers provided in the body or working cylinder of the device, a fluid distributor, so that when the actuating tool comes out of the zone of impact with the working piston, the piston reaches a position lower than the one it reaches in its normal alternating stroke, thereby setting the return chamber in communication with the driving chamber, which is thus connected to the fluid discharge line by means of a passageway provided in a portion of the length of the working piston. This determines that the working piston is stopped from moving, thereby avoiding striking against an empty load.

Likewise, the object of the present invention is to develop an apparatus embodying the afore-cited improvements, by providing a main body having a central cylindrical housing within which an up and down travelling working piston is housed. This housing comprises a driving chamber, wherein the working piston is pushed in a downwardly direction, a return chamber wherein the working piston is pushed in an upward direction, a control chamber, a discharge chamber, and additional end chambers which have no fluid function. The driving chamber is connected with a chamber in a control cylinder, the return chamber is connected with the inlet port for the fluid under pressure, the control chamber of the working cylinder is connected with a corresponding chamber in the control cylinder, and the discharge chamber in the working cylinder is connected with a corresponding chamber in the control cylinder and with a discharge line to a tank. The control cylinder includes a control piston which moves up and down in the chambers which communicates with the afore-cited chambers in the working cylinder in the manner indicated. During the alternating movement of the control piston, the driving chamber in the working cylinder is placed in communication with the inlet port for the fluid under pressure or alternately in communication with the discharge line, thereby determining in the first instance the downward travel of the working piston, and in the second instance the upward travel of the working piston. A single conventional fluid accumulator is connected with fluid inlet port. Sealing joints are provided between the working piston and the working cylinder, these joints being located at least above the driving chamber and below the discharge chamber in the working cylinder.

BRIEF DESCRIPTION OF THE DRAWINGS

In order to render easier the understanding of the present invention, reference will be made to the accompanying drawings wherein an example of an apparatus embodying the improvements of the invention is shown, such example being solely illustrative and not limitive of the invention.

In the drawings.

DETAILED DESCRIPTION OF THE INVENTION

Figure 2:
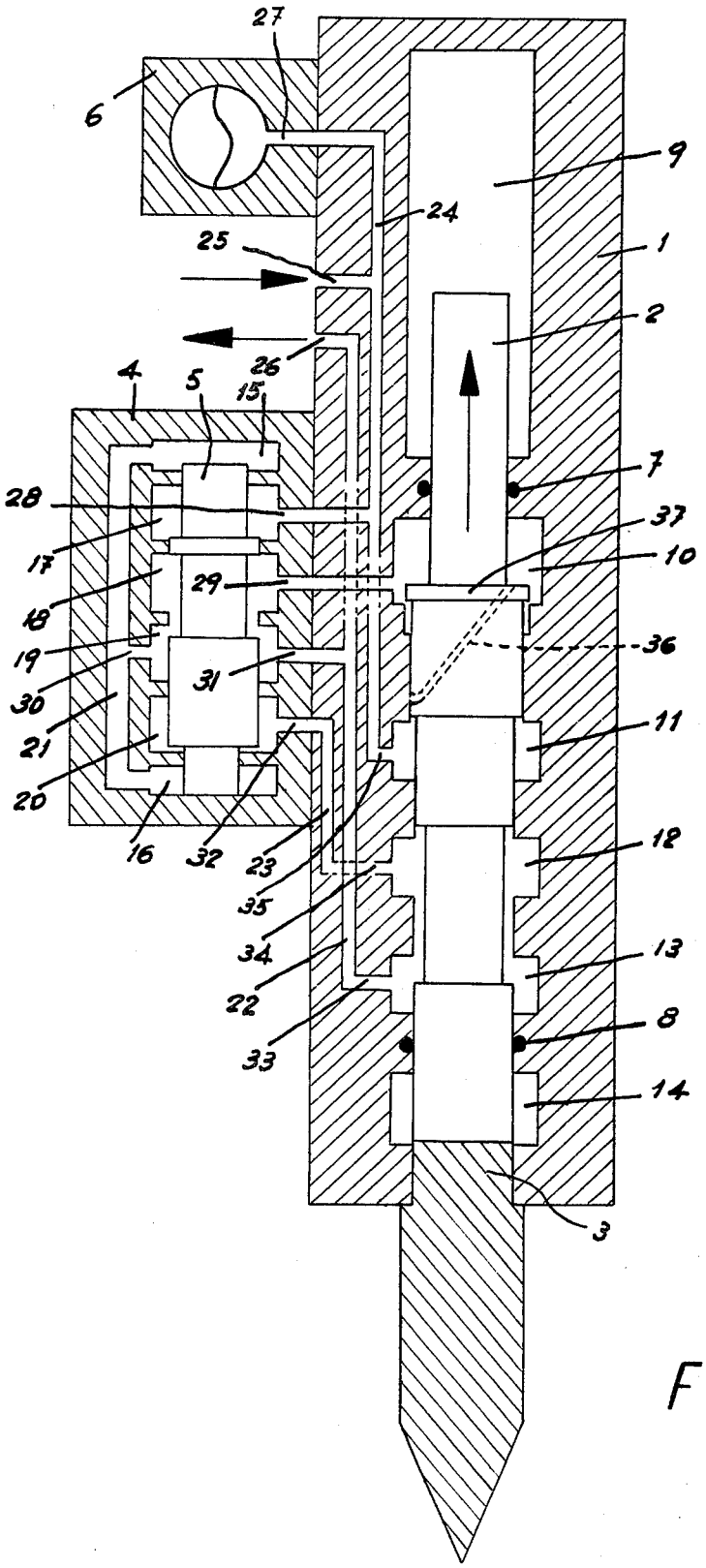
FIG. 2 is a view similar to FIG. 1, but showing the working piston in a position where it is starting its upward or return travel.

According to the drawings, and considering FIG. 2, oil under pressure supplied by a power driven pump flows into an inlet port 25, so that it flows into a hydraulic accumulator 6 through a passage 24 and an inlet 27, thereby loading accumulator 6 with a certain volume of oil under pressure, while the oil flows into a return chamber 11 through the passage 24 and an inlet port 35, thereby pushing upwards a working piston 2, as is indicated by the artow in FIG. 2. At the same time the oil flows through the passage 24 and an inlet 28 into a control cylinder 4, thereby pushing a control piston 5 downwards to a lower end position of its stroke, as is seen from FIG. 2.

In this position, the control piston 5 sets in communication chambers 18 and 19, and closes communication between a return chamber 17 and the chamber 18 and between the chamber 19 and a driving chamber 20, so that there is no pressure in a driving chamber 10 in the working cylinder 1, and in addition, opens communication between the chamber 10 and a discharge outlet 26 via air outlet port 29, the chamber 18, the chamber 19, air outlet 31 and a passage 22.

Figure 1:
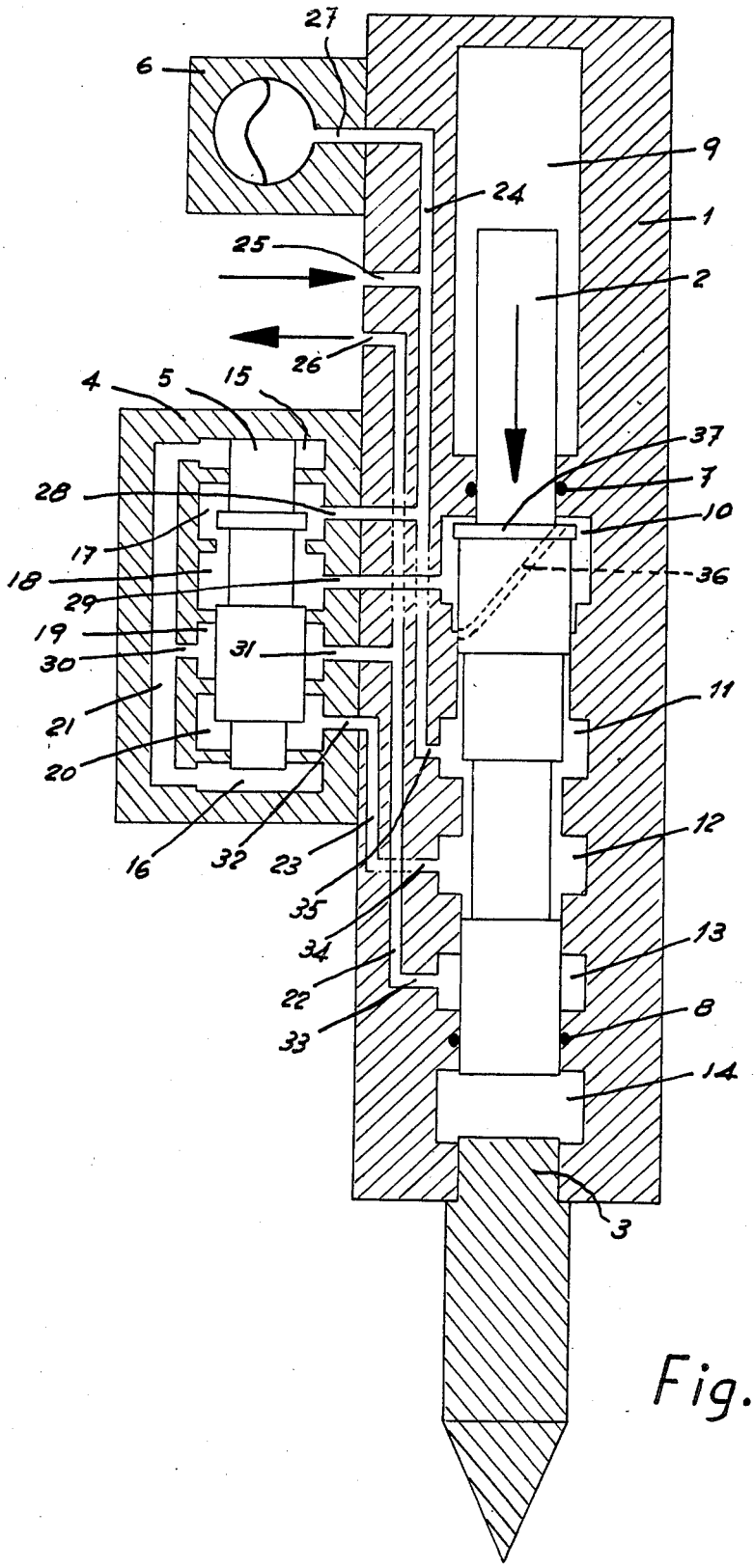
FIG. 1 is a schematic lengthwise section view of the apparatus of the invention in a position where a working piston is starting its downward or acting travel.

The working piston 2 thus moves upwards within its housing, as it is indicated by the arrow in FIG. 2, by the oil under pressure in the return chamber 11, thereby displacing an oil volume in the driving chamber 10 which is forced to flow to a discharge line through the outlet 29, the chamber 18, the chamber 19, the outlet passage 31, the passage 22 and the outlet 26, and shutting off communication between a discharge chamber 13 and a control chamber 12 and opening communication between the control chamber 12 and the return chamber 11, as is to be seen from FIG. 1.

At this moment in the stroke of the working piston the oil under pressure flows from the return chamber 11 to the control chamber 12 and through an opening 34, a passage 23 and an opening 32, and exerts pressure on the control piston 5 in the driving chamber 20. Within the driving chamber 20 the control piston offers a greater thrust area than in the return chamber 17 and is, therefore, pushed to an upper end position of its stroke, as is to be seen from FIG. 1.

A chamber 15 and a chamber 16 are always in open connection through a passage 21 and an opening 30 with the chamber 19 which collects drainage during the operation of the apparatus.

In this position, the driving chamber 20 is shut off from chamber 19, as is the chamber 19 from the chamber 18, but the return chamber 17 is in open communication with the chamber 18, so that the oil under pressure therein flows through passage 29 into the driving chamber 10, wherein the thrust surface of the working piston 2 is larger than that in the return chamber 11, thereby pushing the working piston 2 in a direction opposed to the thrust imparted thereto in the return chamber 11, thereby stopping the upward stroke of the working piston and pushing it downwards, as is to be seen from the arrow in FIG. 1.

There is a moment at which the communication between the return chamber 11 and the control chamber 12 is being shut off, thereby shutting off the oil pressure to the driving chamber 20, and thereafter the control chamber 12 is placed in communication with the discharge chamber 13, so that the oil pressure, which is always acting within the return chamber 17, pushes the control piston 5 downwards up to the point where it reaches its lower end stroke position, as is to be seen from FIG. 2, owing to the fact that the oil pressure is no longer acting in the driving chamber 20, thereby evacuating the oil from the driving chamber 20 to the discharge line and to the tank through the opening 32, the passage 23, the opening 34, the control chamber 12, the discharge chamber 13, the opening 33, the passage 22, and the outlet port 26. All of the elements are in the position shown in FIG. 2, and in this position the working piston 2 strikes against a stone-cutter's chisel 3, thereby producing an impact which is passed on to the material to be worked.

This way the working piston ends its downward travel, end is pushed again upwards by the oil under pressure in the return chamber 11, thereby starting a new cycle under the same circumstances and characteristics as explained before. When the stonecutter's chisel is not operated and is not set on the material to be worked, it can move within its housing and reach a position beyond the reach of the working piston 2, and, therefore, the working piston will not strike against the chisel. In this case, the working piston reaches the lowermost position in its stroke, which is the position where an enlarged part 37 of the working piston 2 comes to lodge in a lower narrowed space in the driving chamber 10. There then takes place a damping or slowing down of the downward movement of the piston, and an oil passageway 36 incorporated in a corresponding length of the working piston can, at a moment during the stroke, place the return chamber 11 in communication with the driving chamber 10, thereby connecting the inlet port 25 for the oil under pressure with the outlet port 26 to the oil tank, through the passage 24, the opening 35, the return chamber 11, the oil passageway 36, the driving chamber 10, the passage 29, the chamber 18, the chamber 19, the passage 31, and the passage 22, so that the operation of the apparatus is stopped. This results in preventing the piston from striking the structure of the apparatus and, thereby, causing it harm, and slowing down the piston in the last portion of its stroke and stopping it. Thus, the cycle of operation is interrupted so long as the chisel is not correctly set on to the material to be worked.

According to the illustrated embodiment the feeding line 25 for the fluid under pressure is connected to a tank containing fluid under pressure and the discharging line 26 discharges the return fluid to such tank, thereby forming a closed circuit, the feeding line 25 comprising a branch passage connected to an accumulator for the fluid under pressure.

Essentially, the apparatus of the present invention includes a working cylinder inside which acts a working piston endowed with an alternating movement to produce impacts on a percussion tool, and a control cylinder inside which acts a control piston endowed with an alternating movement, each one of the two cylinders comprising a driving chamber and means for forcing the fluid under pressure into the driving chamber in order to drive the respective piston in a particular direction, a return chamber, and means for forcing the fluid under pressure into the return chamber in order to move the respective piston in a direction opposed to the former direction. In each one of the two cylinders 1,4 the respective return chamber 11, 17 is constantly connected to a feeding source 25 of fluid under pressure, and the respective driving chamber 10,20 is alternately connected, through a distributor, to feeding source 25 of fluid under pressure and to a discharge 26 of the fluid under pressure. Each of the pistons 2,5 in the respective return chamber 11,17 offers a thrust surface, on which acts the fluid under pressure, which is smaller than the thrust surface on which acts the fluid under pressure in the respective driving chamber 10,20.

The distributor to which the driving chamber 10 in the working cylinder 1 is connected consists of the control cylinder 4 and its piston 5, and the distributor to which the driving chamber 20 in the control cylinder 5 is connected consists of the working cylinder 1 and its piston 2.

Each one of the two cylinders 1 and 4 comprises, in succession to the respective return chamber 11,17, a respective first distribution chamber 12,18 connected to the driving chamber 20,10 in the other one of the two cylinders 4,1, and a respective second distribution chamber 13,19 connected to the discharge 26 of the fluid under pressure. The respective pistons 2,5 form in portions of their lengths recesses which connect first distribution chamber 12,18 with the second distribution chamber 13,19 of the respective cylinder 1,4 when the piston 2,5 has reached a first end position, and which connect in a second end position of the pistons 2,5 the first distribution chamber 12,18 with the return chamber 11,17 in the cylinder 1,4.

What I claim is:

1. A fluid actuating apparatus of the type including a fluid circuit and a plurality of actuating members which have imparted thereto alternating movement governed by said fluid circuit, said apparatus comprising:

a working cylinder;

a working piston mounted for movement in opposite first and second directions within said working cylinder;

a control cylinder;

a control piston mounted for movement in opposite first and second directions within said control cylinder;

a fluid feeding line for a source of fluid under pressure permanently connected to a return chamber in said working cylinder and to a first chamber in said control cylinder;

a working chamber in said working cylinder permanently connected to a second chamber in said control cylinder;

a fluid discharge line for discharging fluid permanently connected to a discharge chamber in said working cylinder and to a third chamber in said control cylinder;

a control chamber in said working cylinder permanently connected to a fourth chamber in said control cylinder; and said working piston and said control piston each including means cooperating with said working cylinder and said control cylinder, respectively, for opening and closing communication between selected ones of said chambers in said working cylinder and said control cylinder, such that in an initial stage of the cycle of operation of the apparatus said working piston is in a first position thereof adapted to contact a percussion tool and said control piston is in a first position thereof whereat said second and third chambers thereof are in communication, thereby permitting driving of said working piston to a second position thereof spaced from the percussion tool, at which second position of said working piston said return chamber and said control chamber are in communication, thereby causing driving of said control piston to a second position thereof at which said first and second chambers are in communication, thereby causing said working piston to be moved toward said first position thereof to strike the percussion tool, at which first position said control chamber and said discharge chamber are in communication, thereby permitting said control piston to be moved to said first position thereof, whereat the cycle of operation starts anew.

2. An apparatus as claimed in claim 1, wherein said working piston and said driving chamber are provided with means which cooperate to damp the movement of said working piston at the end of the stroke thereof toward said first position thereof when the percussion tool is not set on material to be worked and thus is out of the range of positions to be struck by said working piston.

3. An apparatus as claimed in claim 1, further comprising means for connecting said return chamber to said driving chamber when said working piston is connected to said fluid discharge line, to prevent the start of a new cycle of operation when the percussion tool is not set on material to be worked and thus is out of the range of positions to be struck by said working piston.

4. An apparatus as claimed in claim 3, wherein said connecting means comprises a passageway which extends from a surface of said working piston on which acts fluid under pressure in said driving chamber to a point on the side surface of said working piston located at a position such that, if the stroke of said working piston were to be extended toward the percussion tool, said point would be within said return chamber.

5. An apparatus as claimed in claim 1, wherein said fluid feeding line is connected to a tank containing fluid under pressure, and said fluid discharge line discharges return fluid to said tank, thereby forming a closed circuit, and further comprising a branch passage from said fluid feeding line extending to an accumulator for accumulating fluid under pressure.

* * * * *